US009028212B1

(12) United States Patent
Tom

(10) Patent No.: US 9,028,212 B1
(45) Date of Patent: May 12, 2015

(54) 50 CFM BATH FANS WITH LENS COVER AND FLAPS/EARS THAT ALLOW HOUSINGS TO BE MOUNTED TO JOISTS

(75) Inventor: Lawrence Tom, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 723 days.

(21) Appl. No.: 13/289,312

(22) Filed: Nov. 4, 2011

Related U.S. Application Data

(63) Continuation-in-part of application No. 29/401,838, filed on Sep. 16, 2011, now Pat. No. Des. 678,497.

(51) Int. Cl.
*F04D 29/52* (2006.01)
*F04D 29/64* (2006.01)
*F04D 1/04* (2006.01)

(52) U.S. Cl.
CPC ..... *F04D 1/04* (2013.01)

(58) Field of Classification Search
CPC ..... F04D 29/626; F04D 29/4226; F24F 7/06; F24F 7/007
USPC ..... 415/213.1; 416/5
See application file for complete search history.

(56) References Cited

U.S. PATENT DOCUMENTS 2,689,906 A * 9/1954 Corbett ..... 392/347
2,697,163 A 12/1954 Spear
2,950,859 A 8/1960 Kirk
3,068,341 A 12/1962 Ortiz
3,785,271 A 1/1974 Joy
4,510,851 A 4/1985 Sarnosky
4,589,476 A 5/1986 Berner
4,726,559 A 2/1988 Hultmark
4,867,640 A 9/1989 Penlesky
5,232,152 A * 8/1993 Tsang ..... 236/44 A
5,934,783 A 8/1999 Yoshikawa
6,161,175 A 12/2000 Kim
6,261,175 B1 7/2001 Larson
D457,232 S 5/2002 Miura
D457,616 S 5/2002 Yamanaka
6,488,579 B2 12/2002 Larson
6,802,770 B2 10/2004 Larson
6,897,580 B2 5/2005 White
6,979,169 B2 12/2005 Penlesky
D521,145 S 5/2006 Craw
7,128,303 B2 10/2006 Penlesky (Continued)

OTHER PUBLICATIONS

Tom, Office Action from U.S. Appl. No. 13/233,700, filed Sep. 15, 2011 mailed from the USPTO on Jan. 8, 2015, 25 pages.

(Continued)

*Primary Examiner* — Liam McDowell
(74) *Attorney, Agent, or Firm* — Brian S. Steinberger; Law Offices of Brian S. Steinberger, P.A.

(57) ABSTRACT

Apparatus, systems and methods of 50 CFM exhaust and ventilation fans for bathrooms with grill covers having removable light lens covers, and flaps/ears that allow the housings to mount directly to joists and/or other structural members inside of a ceiling or inside of a wall. The housing can include a mounting plate having a motor with attached impeller thereon, wherein the mounting plate with motor and attached impeller and electrical connectors can be removed as a single unit from the housing for accessing and inspecting interior wire connections during inspection and for ease in replacing parts such as burned out motors overtime.

12 Claims, 18 Drawing Sheets

(56) References Cited

U.S. PATENT DOCUMENTS

| | | | |
|---|---|---|---|
| D535,433 | S | 1/2007 | Craw |
| 7,175,309 | B2 | 2/2007 | Craw |
| 7,203,416 | B2 | 4/2007 | Craw |
| D565,716 | S | 4/2008 | Jacak |
| D575,387 | S | 8/2008 | Zakula |
| D577,805 | S | 9/2008 | Adrian |
| D581,508 | S | 11/2008 | Miyake |
| 7,455,432 | B2 | 11/2008 | Craw |
| 7,455,500 | B2 | 11/2008 | Penlesky |
| 7,481,559 | B1 | 1/2009 | Rashidi |
| 7,654,495 | B2 | 2/2010 | Adrian |
| 7,993,037 | B1 | 8/2011 | Buse |
| D653,323 | S | 1/2012 | Jacak |
| 8,104,502 | B2 | 1/2012 | Nakata |
| D654,998 | S | 2/2012 | Zakula |
| 2008/0261508 | A1 | 10/2008 | Deng |
| 2008/0318515 | A1 | 12/2008 | Yeung |
| 2009/0073702 | A1 | 3/2009 | Craw |
| 2009/0170421 | A1 | 7/2009 | Adrian |
| 2010/0009621 | A1 | 1/2010 | Hsieh |
| 2010/0226139 | A1 | 9/2010 | Lynch |

OTHER PUBLICATIONS

Tom, Amendment Response from U.S. Appl. No. 13,233,700, filed Sep. 15, 2011 filed with USPTO on Oct. 3, 2014, 13 pages.

* cited by examiner

50 CFM BATH FANS WITH LENS COVER AND FLAPS/EARS THAT ALLOW HOUSINGS TO BE MOUNTED TO JOISTS

This invention is a Continuation-In-Part to U.S. Design patent application Ser. No. 29/401,838 filed Sep. 16, 2011, now U.S. Pat. No. Des. 678,497, which is incorporated by reference in its' entirety.

FIELD OF INVENTION

This invention relates to ventilation exhaust fans, and in particular to apparatus, systems and methods of 50 CFM ventilation exhaust fans for bathrooms with lens covers and flaps/ears that allow the housings to mount directly to joists in a ceiling or wall.

BACKGROUND AND PRIOR ART

Various types of bathroom ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bath fans are difficult to be installed into a ceiling since the housings cannot be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan.

Thus, the need exists for solutions to the above problems with the prior art.

SUMMARY OF THE INVENTION

A primary objective of the present invention is to provide exhaust fans, apparatus, systems and methods for use in bathrooms having flaps/ears on the housings and blowers that provides 50 (fifty) CFM (cubic feet of air per minute) of airflow.

A secondary objective of the present invention is to provide exhaust fans, apparatus, systems and methods for use in bathrooms, having lights where air flow does not pass into the light box so that moisture will not affect internal electrical components.

A third objective of the present invention is to provide exhaust fans, apparatus, systems and methods for use in bathrooms, where a motor and blower are mounted to a mounting plate, in order to allow for easy removal of the motor and blower for replacing parts and checking wires.

A fourth objective of the present invention is to provide exhaust fans, apparatus, systems and methods for use in bathrooms, where a motor and blower and mateable electrical connectors for the motor and a light are mounted to a mounting plate, in order to allow for easy removal of the motor and blower for replacing parts and checking wires.

A fifth objective of the present invention is to provide exhaust fans, apparatus, systems and methods for use in bathrooms, wherein electrical connections are inside of the box and not exposed to air and moisture outside of the box.

An exhaust fan embodiment can include a housing having closed side walls, an open top and open bottom, a blower wheel inside of the housing, a motor for running the blower wheel, a grill cover having vents for allowing air to be pulled into the housing by the blower wheel, a lens cover in the grill cover for covering a light source under the grill cover that is mounted in a light box, wherein the motor powered blower pulls air through the vents of the grill around the light box and not into the light box, in order to be exhausted from the housing.

The motor can be a 50 (fifty) CFM (cubic feet per minute) generating motor.

The housing can include external flaps attached to an exterior of the housing for mounting the housings directly to structural supports within a ceiling. The external flaps can include keyhole slots for allowing the housings to be flush mounted to the structural supports by fasteners being inserted into and locked with the keyhole slots. The flaps can include a base plate fastened to an external side corner of the housing, and flap plate attached at an angle to the base plate, the flap plate having a fastening opening for mounting the housing to a joist. The flaps can also have a hinge for allowing the flap plate to swing relative to the base plate.

The housing can include a removable mounting plate having the motor and the blower wheel pre-attached thereto, wherein the mounting plate with the motor and blower wheel are removable as a single piece from the inside of the housing. The removable mounting plate can include a central opening for extending the motor down therethrough. The mounting plate can include a bracket for attaching mateable electrical connectors for the light source and the motor, to the removable mounting plate.

The fan can also include a curved plate member to airflow and minimizes excess noise from air being moved from the blower wheel.

The lens cover can include a depressible and releaseable fastener for allowing the lens cover to be latched onto the grill cover by depressing a portion of the lens cover, and for allowing the lens cover to be removed by depressing the portion of the lens cover.

A ceiling mounted exhaust fan, can include a housing having closed side walls, an open top and open bottom, a motor attached to an impeller, and a mount plate member with an opening therethrough, the plate member having edge portions mounted inside of the housing so that the motor when mounted to the plate member allows for the motor to extend through the opening in the mount member, wherein the mount with mounted motor and attached impeller are removable as a single unit from the housing.

The motor can be a 50 (fifty) CFM (cubic feet per minute) generating motor.

The fan can include a bracket for attaching mateable electrical connectors for the light source and the motor, to the removable mounting plate The fan housing can include a sealed light box, a light source mounted in the light box, and a removable lens cover overlaying the light source.

The housing can include external flaps attached to an exterior of the housing for mounting the housings directly to structural members inside of a ceiling. The flaps can include a base plate fastened to an external side corner of the housing, and a flap plate attached at an angle to the base plate, the flap plate having a fastening opening for mounting the housing to a joist.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

50 CFM Bath Exhaust Fans with Flaps/Ears.

A list of the components for FIGS. 1-15 will now be described.

Figure 1:
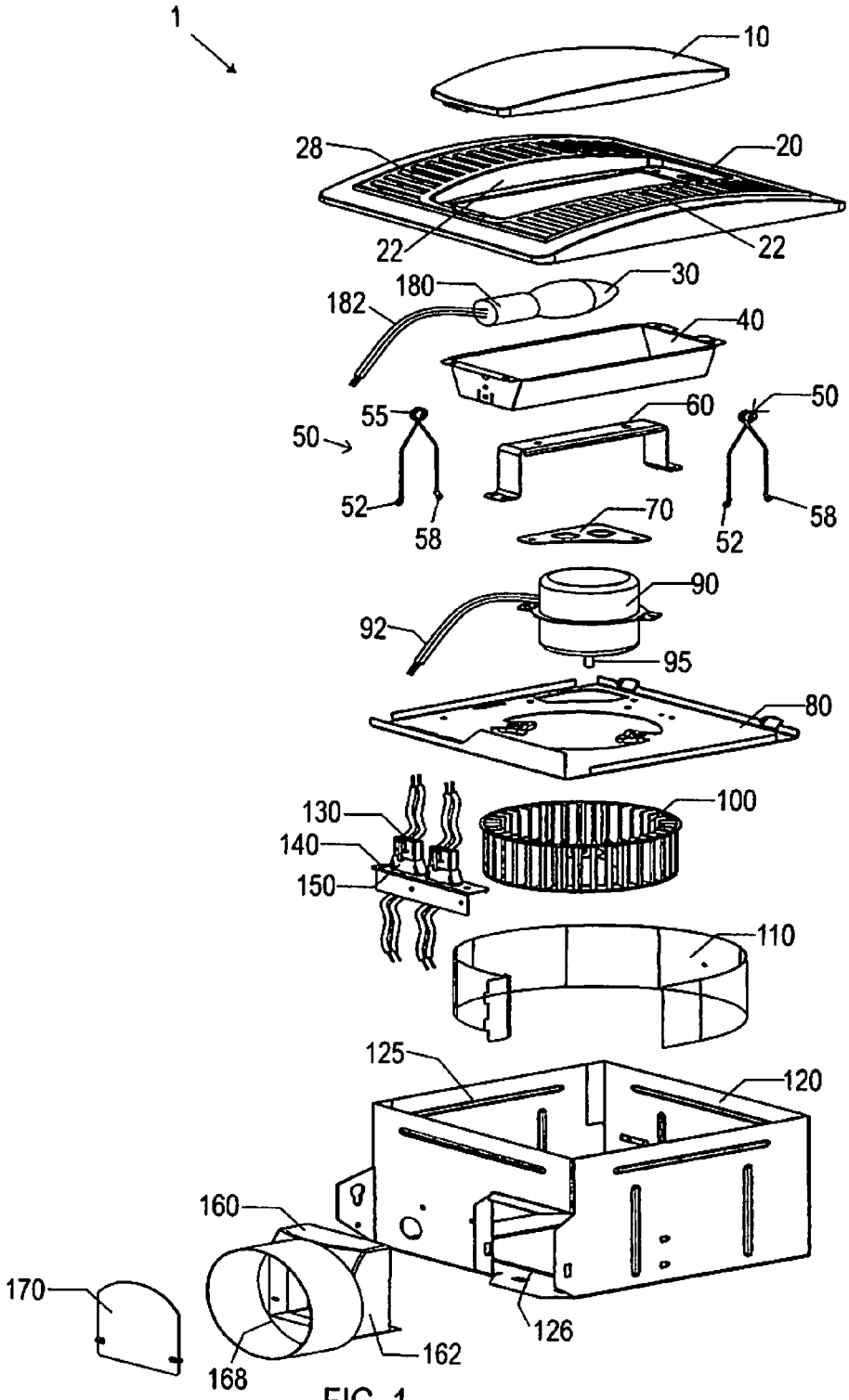
FIG. 1 is an exploded perspective view of a 50 CFM bath fan housing with lens cover, grill, light box, light, motor, blower, mount, electrical connectors, deflector, and outlet.
Figure 2:
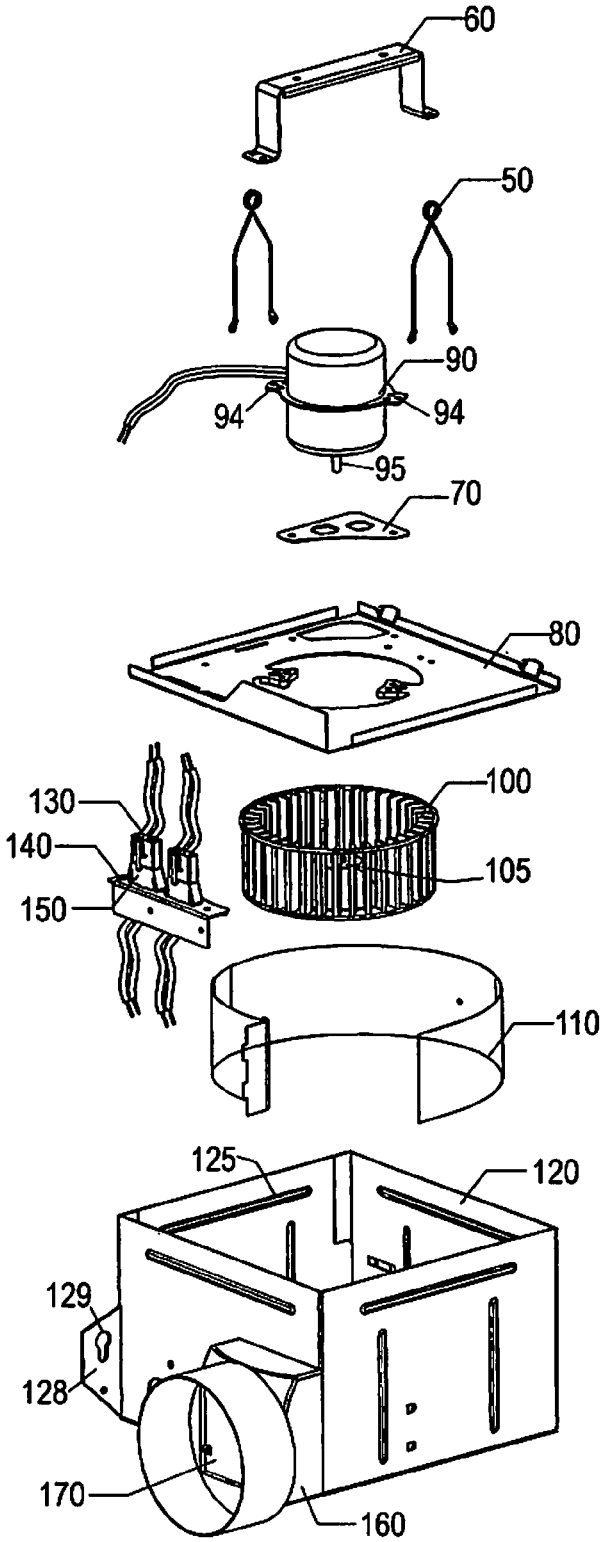
FIG. 2 is another exploded view of the 50 CFM bath fan housing of FIG. 1 without the lens cover, grill, light box and lights.
Figure 3:
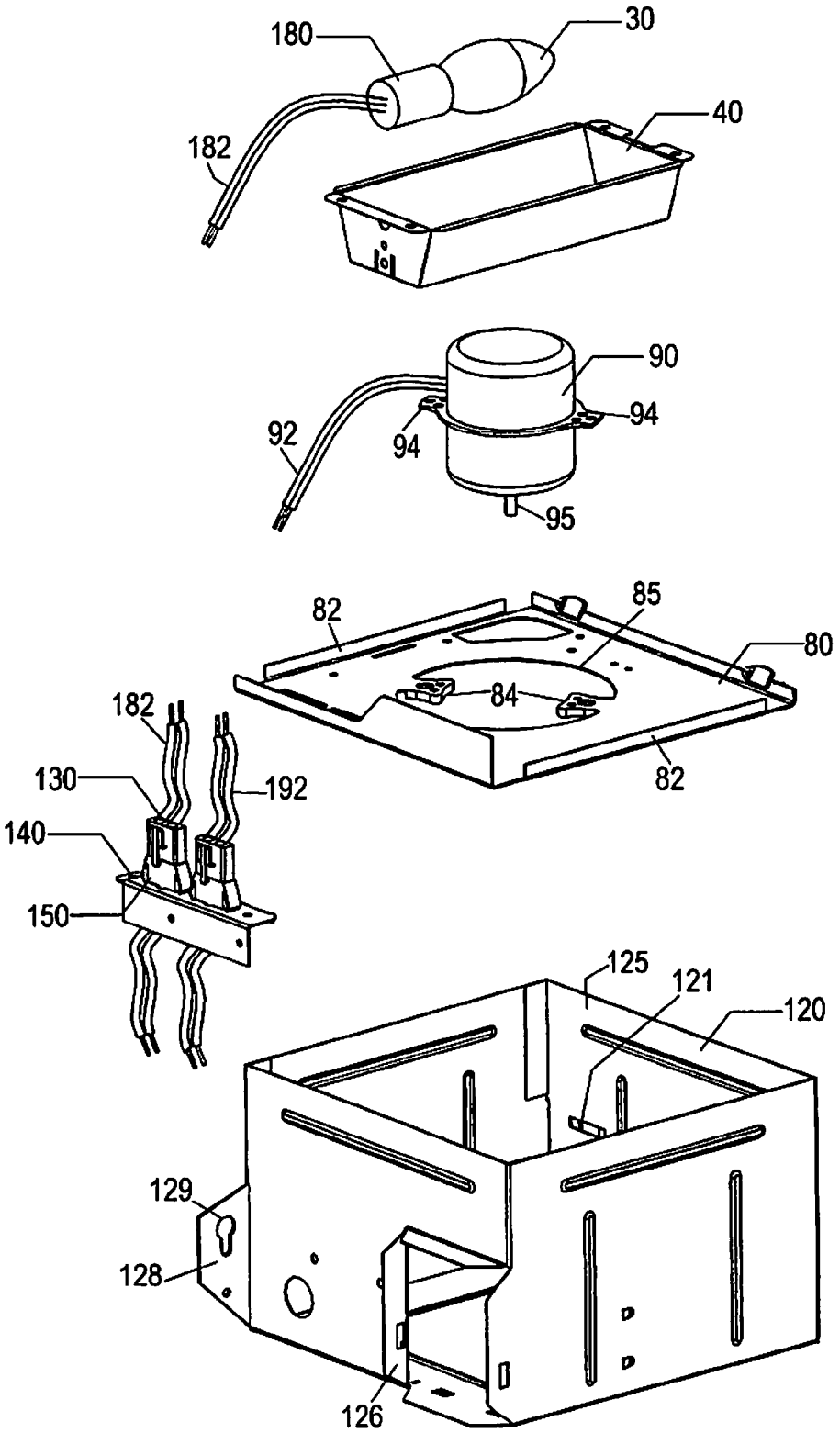
FIG. 3 is another exploded view of the 50 CFM bath fan housing of FIG. 1 with light, light box, motor, mount, electrical connectors.
Figure 4:
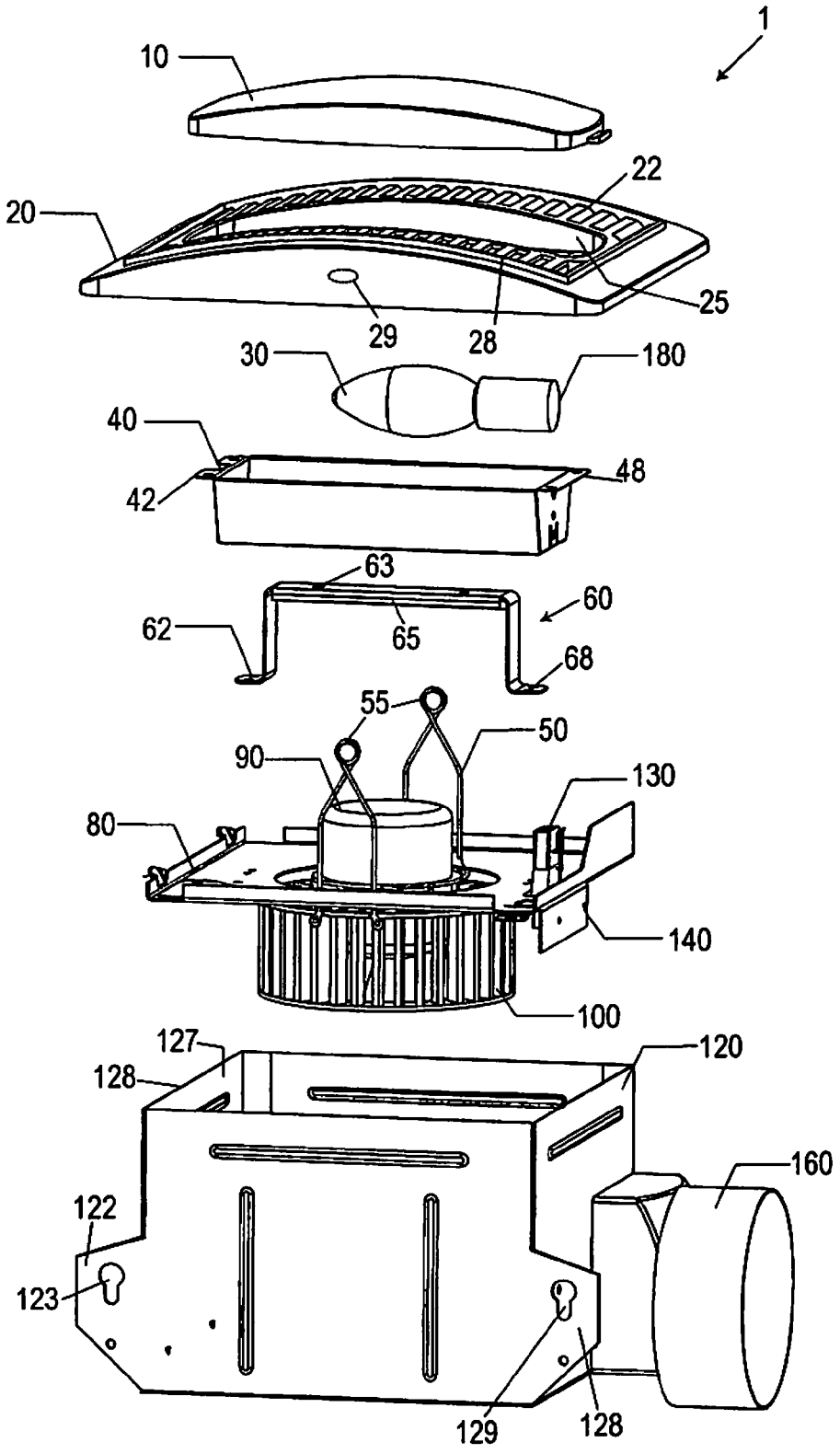
FIG. 4 is another exploded view of the 50 CFM bath fan housing of FIG. 1 with assembled motor and blower and springs mounted to the removable mount plate.

1. 50 CFM embodiment
10. grill lens (lens cover)
12. free end (push down end) with male prong
14. sidewall
15. top of lens
16. sidewall
18. hinged end
20. grill
22. side vents
25. central opening
26. hinge slot
28. side vents
29. inwardly protruding tabs attach to springs
30. light source (bulb)
40. light box.
42. bent edge
48. bent edge
50. spring (2)
52. outer end
55. apex end
58. outer end
60. light box bracket
62. footer end
63. fastening slot(s)
68. footer end
70. wire buckle fixed plate
80. motor mounting plate
82. bent side edges
85. central opening
84. inwardly protruding flanges
90. motor
92. power line to motor
94. side flanges
100. impeller (blower)
110. wind deflector
120. housing
121. ledge clip(s)
122. first flap-ear
123. keyhole slot
125. open top
126. rectangular outlet opening
127. upper edges about open top
128. second flap-ear
129. keyhole slot
130. male plug 2-pin (2)
140. plug plate
150. female plug 2-pin (2)
160. outlet
168. opening in outlet
170. damper
180. lamp socket
182. power line to socket
300. Grill lens connecting block chip (depressible engageable and releasable fastener)
310. inside part with bendable prong arms
312. bendable prong arms
320. outside box
322. top end with enlarged edges
340. internal spring
400. male prong with enlarged head
410. shaft
420. enlarged head FIG. 1 is an exploded perspective view 1 of a 50 CFM bath fan housing 120 with lens cover 10, grill 20, light box 40, light 30, motor 90, blower 100, mount plate 80, electrical connectors 130, 140, 150, wind deflector, outlet 160 and damper 170. FIG. 2 is another exploded view 1 of the 50 CFM bath fan housing 120 of FIG. 1 without the lens cover 10, grill 20, light box 40 and light 30. FIG. 3 is another exploded view of the 50 CFM bath fan housing 120 of FIG. 1 with light, light box 40, motor 90, mount plate 80, and electrical connectors 130-150. FIG. 4 is another exploded view 1 of the 50 CFM bath fan housing 120 of FIG. 1 with assembled motor 90 and blower 100 and springs 50 mounted to the removable mount plate 80.

Referring to FIGS. 1-4, the bath fan housing 120 can have a rectangular metal box configuration with closed sidewalls and closed bottom that are pre-fastened together by rivets, and the like, with an open top. For example, five metal pre-formed plates can be riveted together to form the open top box.

Figure 15:
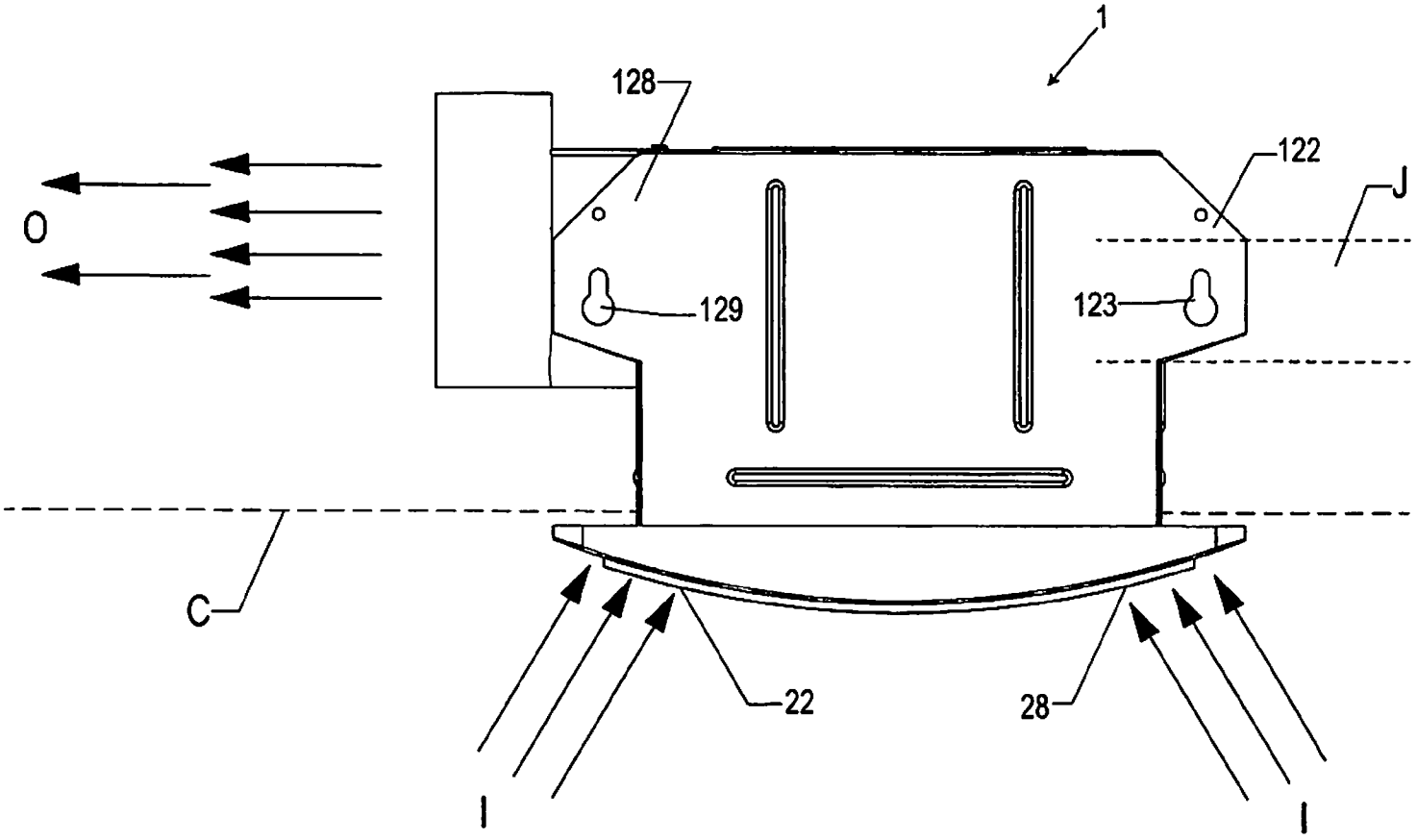
FIG. 15 is a side view of an installed 50 CFM bath fan housing of FIG. 5 showing airflow.

Extending from outer edges of at least one sidewall of the box 120 can be ear-flap type flanges 122, 128, each with slots 123, 129, such as keyhole slots, that allow the housing 120 to be mounted to structural supports, such as but not limited to joists, and the like above a ceiling in a bathroom (which is shown in relation to FIG. 15). Extending from one of the sidewalls of the housing 120 can be an air exhaust outlet 160, which can include a pivotally mounted damper 170. The exhaust outlet 160 can have a male protruding end 162 attached to a rectangular outlet opening 126 of the housing 120. The pivotal outlet damper 170 can be attached to the exterior opening 168 of the outlet 160

A curved metal type wind deflector 110, can be mounted by fasteners, such as but not limited to rivets, screws, and the like, to either or both the floor and/or interior sidewall(s) inside of the housing 120. The curved deflector 110, such as a curved metal plate, can direct air from the rotating blower 100 to be directed toward the outlet 160. The curved plate 110 can be used to both guide the airflow and minimizes excess noise.

The motor 90 that can be used in these bath fans can be an electrical motor that can rotate and generate air at 50 CFM. The electrical motor 90 can have a rotating axle portion 95 having an end that fits into a central portion 105 of a blower wheel (impeller) 100. The impeller 100 can have a disc shaped base 105 with blades perpendicular to and extending outward from a midportion therefrom in a cylindrical configuration.

The motor 90 with attached impeller 100 can be mounted into a central opening 85 of a metal type mounting plate 80, by flange edges 94 on the sides the motor 90 that attach to inwardly protruding flanges 84 on the mounting plate 80 using fasteners, such as but not limited to screws and bolts. Together, the motor 90 and impeller 100 are attached to the mounting plate 80 by the flanges 84 and 94 that can be easily attached and detached from one another by the removable fasteners (screws, bolts, and the like). Antivibration and anti-noise members, such as but not limited to rubber pads, and the like, can be sandwiched between the mounting flanges 84, 94.

When attached the impeller 100 with motor 90 can extend through the middle opening 85 of the mounting plate 80. The mounting plate 80 can have bent side edges 82 which allow the mounting plate 80 with mounted motor 90 and impeller 100 to be attached to interior sidewalls of the housing 120 by various removable type fasteners, such as screws and bolts, and the like. The bent edges 82 can also sit on plural ledge clip(s) 121 arranged about an interior perimeter edge inside of the housing 120.

In a preferred embodiment, the impeller 100 and motor 90 are preattached to the mounting plate 80 so that all of these components can be installed at once, and removed at once. The combined one piece motor/impeller/mount assembly allows inspectors, such as home inspectors, and the like, to be able to more easily attach and visually inspect electrical connections (130, 140, 150) by being able to insert and remove this one-piece assembly of components. Additionally, removing the combined plate 80 mounted motor 90 and impeller 100 allows for replacement of parts, such as a burned out motor to be more easily accomplished after the fan has been installed.

Additionally, the outer bent ends 52, 58 of the springs 50 can be located between the motor 90 and the perimeter of the opening 85, so that the expanding outer ends 52, 58 catch about the lip edge of the opening 85 in the mounting plate 80. The springs (spring clips) 50 can have an apex portion 55 that attach to inwardly protruding members 29 on the inside walls of the grill cover 20, so that the springs 50 attach the grill cover 20 to the housing 120.

The pair of spring clips 50 can springably hold the grill cover 20 to cover the top opening 125 of the blower housing 120. The pair of grill clips 50 can each be scissor clips each having an apex 55 that can attach to an inner protruding portion 29 (FIG. 4) along a sidewall of the grill cover 20. The cover 20 can be attached by pressing together the leg ends 52, 58 of the clips 50 (FIG. 1), so that the bottom bent edges 52, 58 can be inserted to catch inside edges under the opening 85 of the mounting plate 80 within the housing 120.

Figure 5:
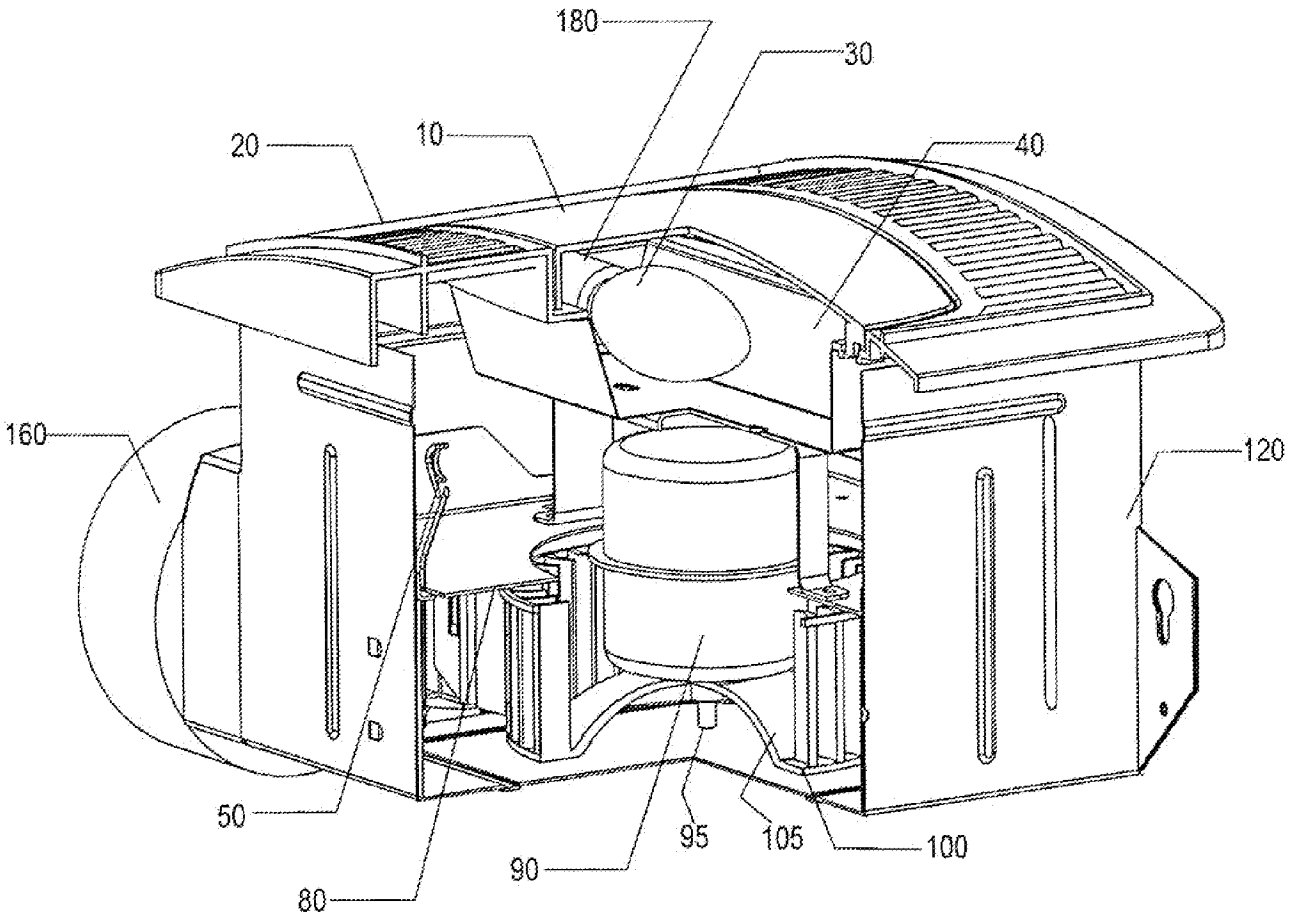
FIG. 5 is a perspective assembled view of the 50 CFM bath fan housing of FIG. 1 with partial cut-away.
Figure 6:
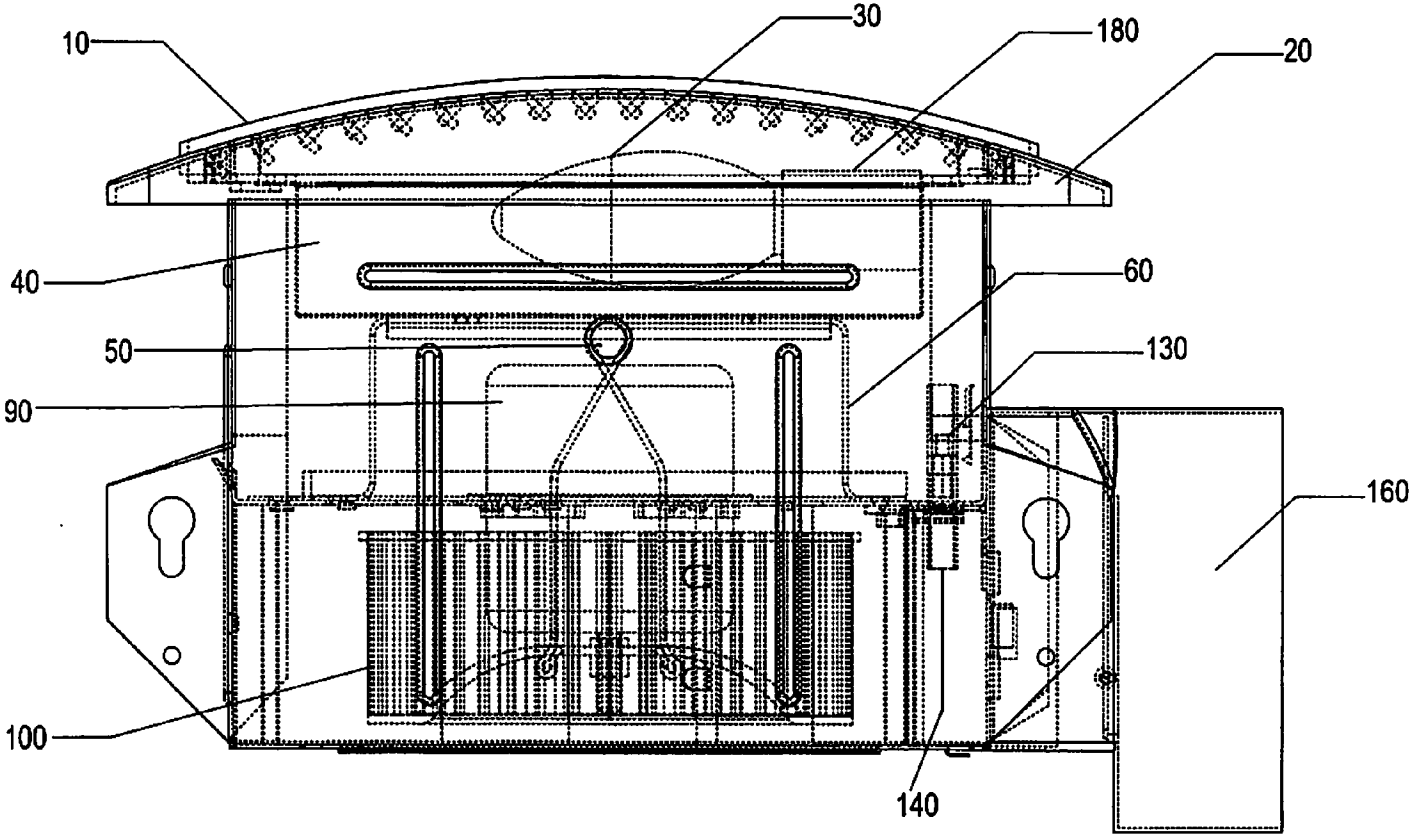
FIG. 6 is a cross-sectional view of the assembled 50 CFM bath fan housing of FIG. 5.
Figure 7:
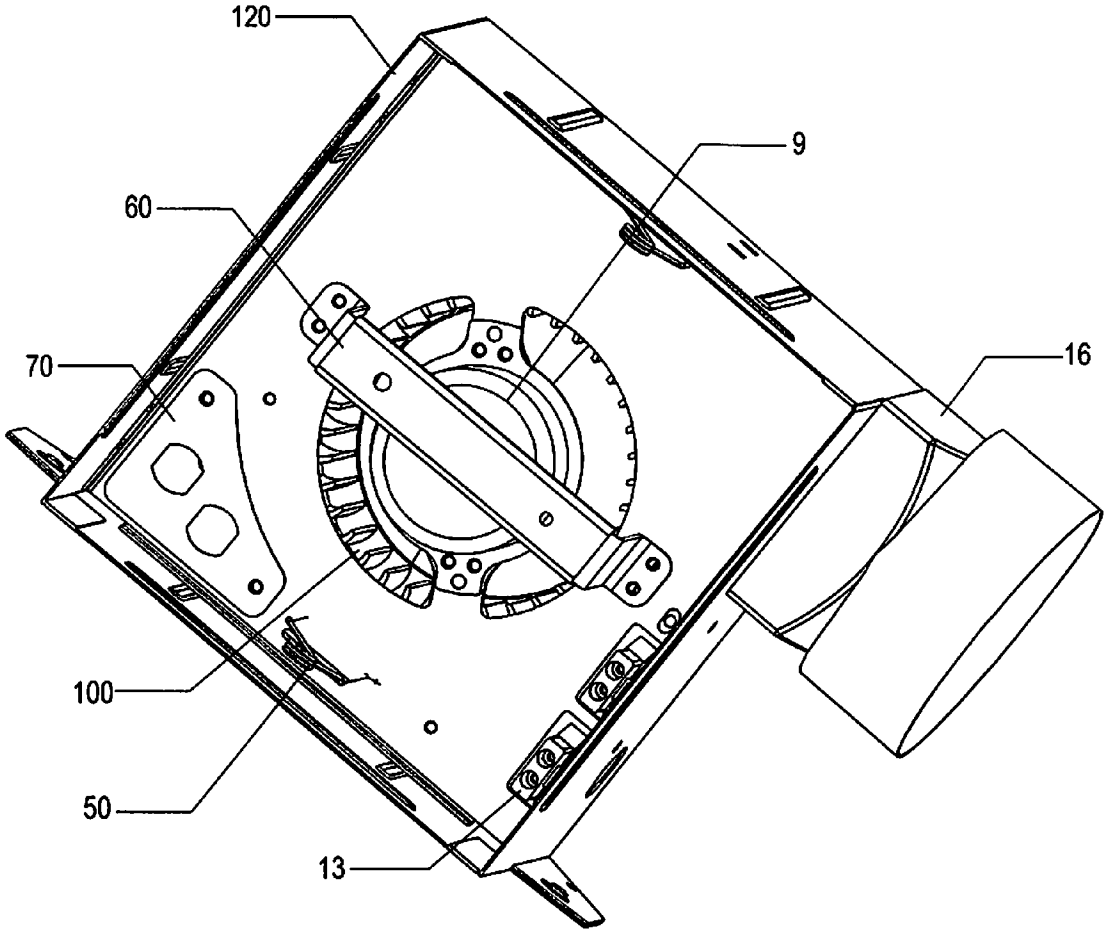
FIG. 7 is a perspective top view of the assembled 50 CFM bath fan housing of FIG. 5 with lens cover, grill and light box removed.
Figure 8:
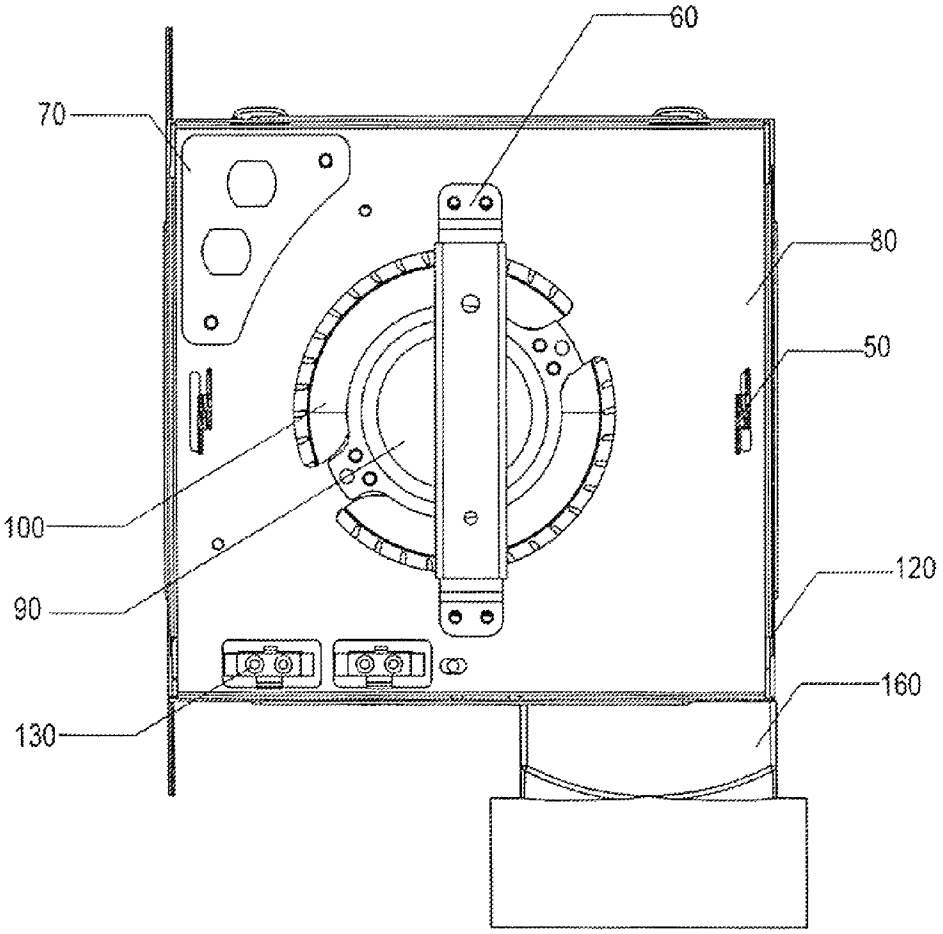
FIG. 8 is a top view of FIG. 7 of the assembled 50 CFM bath fan housing with lens cover, grill and light box removed.
Figure 9:
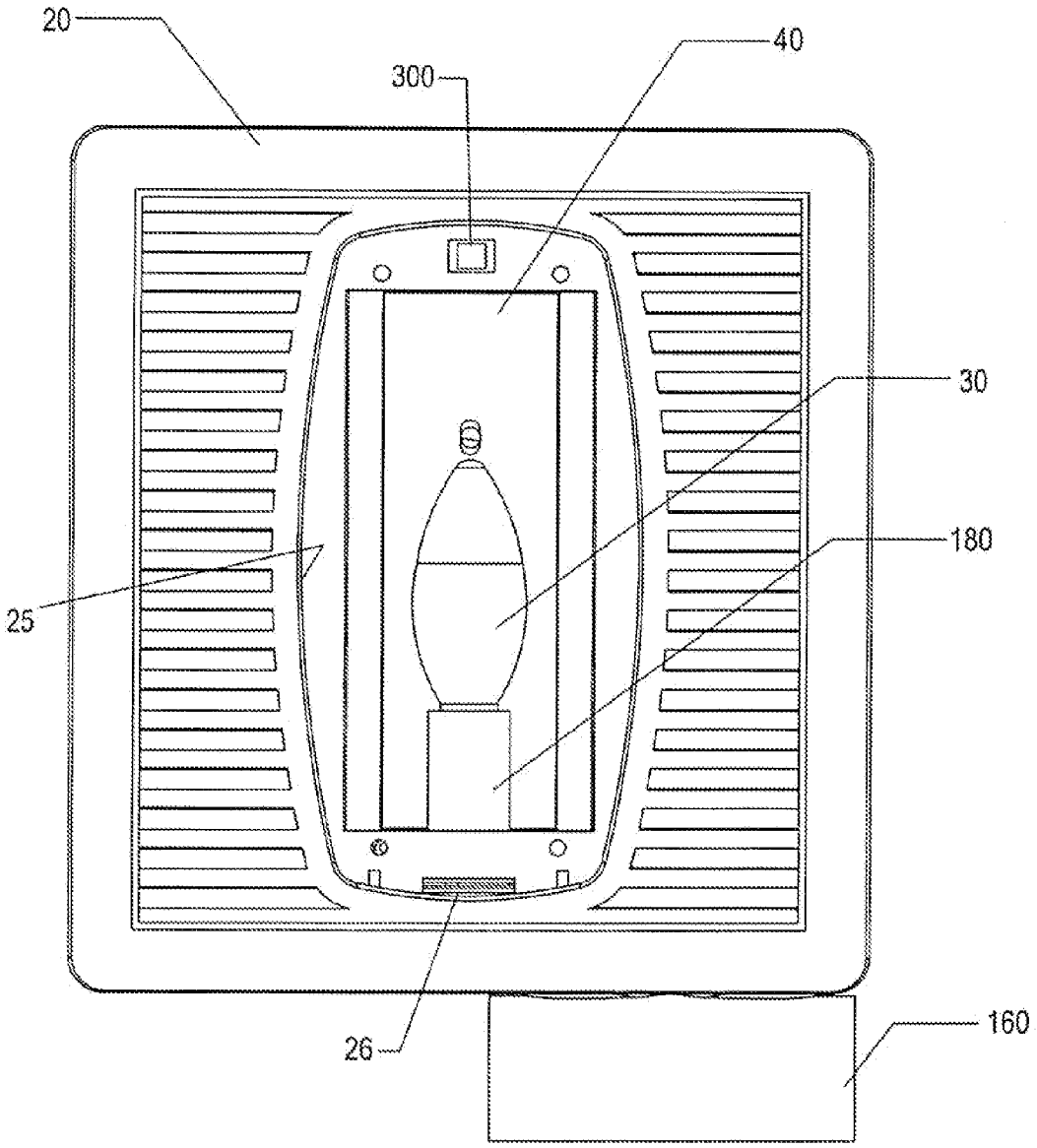
FIG. 9 is a top view of the assembled 50 CFM bath fan housing of FIG. 5 without the lens cover.

FIG. 5 is a perspective assembled view of the 50 CFM bath fan housing 120 of FIG. 1 with partial cut-away. FIG. 6 is a cross-sectional view of the assembled 50 CFM bath fan housing 120 of FIG. 5. FIG. 7 is a perspective top view of the assembled 50 CFM bath fan housing 120 of FIG. 5 with lens cover 10, grill 20 and light box 40 removed. FIG. 8 is a top view of FIG. 7 of the assembled 50 CFM bath fan housing 120 with lens cover 10, grill 20 and light box 40 removed. FIG. 9 is a top view of the assembled 50 CFM bath fan housing 120 of FIG. 5 without the lens cover 10.

Referring to FIGS. 1-9, an inverted U-shaped bracket 60 with footer ends 62, 68 can be mounted to surface portions of the mounting plate 80 by removable fasteners, such as but not limited to screws, bolts, and the like. A bottom floor portion of a metal type light box 40 can be mounted to a mid portion 65 of the light box bracket 60 by fasteners, such as screws, bolts, and the like. The inside of the light box 60 can be closed so that no air can pass through the bottom or sidewalls of the inside of the light box 60. As such, any moisture in the air will not be pulled into the light box to affect any of the electrical components in the box. A lamp socket 180 can be mounted inside of the light box 60 and have a light source 30, such as a bulb 30 attached to the socket 180. The light box 140 can have bent flange edges 142, 148 that can also be attached to upper edges 127 of the housing 120 by fasteners, such as screws, bolts, and the like.

Light power line 182 and motor power line 92 connect to respective male plugs 130 which are mateably attached to female plugs 150, where the male and female connectors 130, 150 can be mounted inside of the housing 120 by a plug plate 140. The plug plate 140 can be attached to an opening in the motor plate 80 by fasteners, such as rivets, screws, bolts, and the like. As previously described, the combined one piece motor/impeller/mount assembly (mounted to plate 80) allows inspectors, such as home inspectors, and the like, to be able to more easily attach and visually inspect electrical connections (130, 140, 150) by being able to insert and remove this one-piece assembly of components.

The wire buckle fixed plate 70, shown in FIGS. 1, 2, 7 and 8 can be a metal plate to cover the wiring connections 130, 140, 150, and can be held by fasteners, such as screws and the like, to either or both an inner wall of the housing 120 or to the mounting plate 80. Plate 70 can have openings, such as rectangular openings, for the male 130 and female plug connections that supply power to the motor 90 and the light 30.

The grill cover 20 can include grill vents 22, 28 on both sides of a central opening 25 with the light box 40 is beneath, and in which a lens cover 10 covers the opening 25.

Figure 10A:
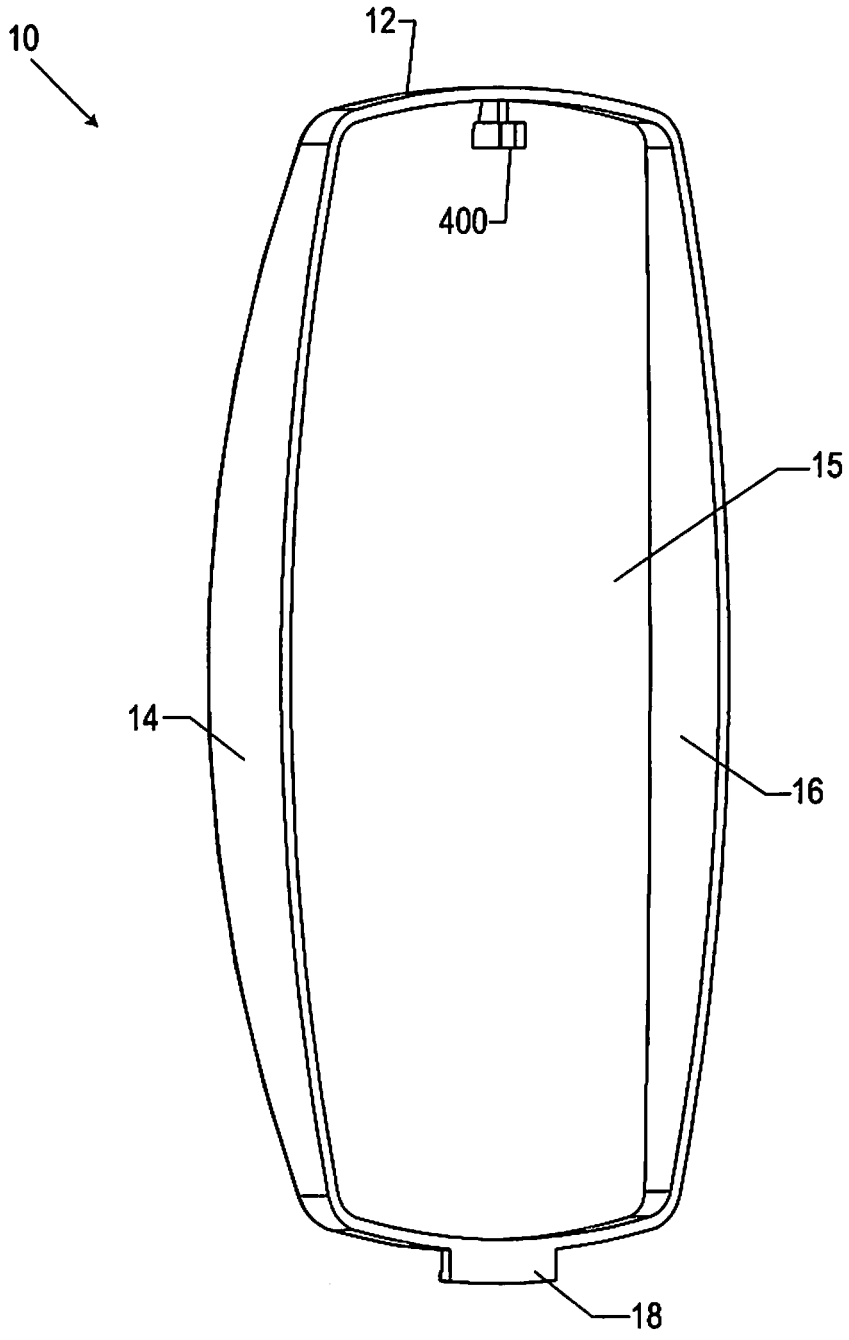
FIG. 10A is a perspective view of the bottom of the lens cover from the bath fan of FIG. 1.
Figure 10B:
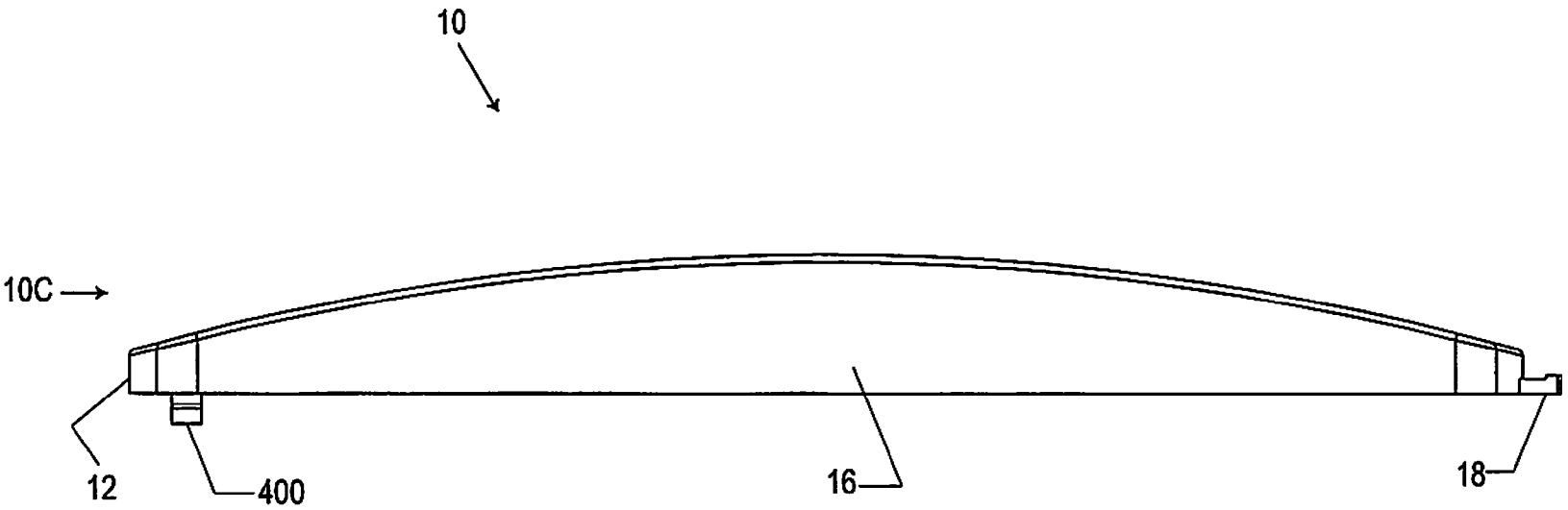
FIG. 10B is a side view of the lens cover of FIG. 10A.
Figure 10C:
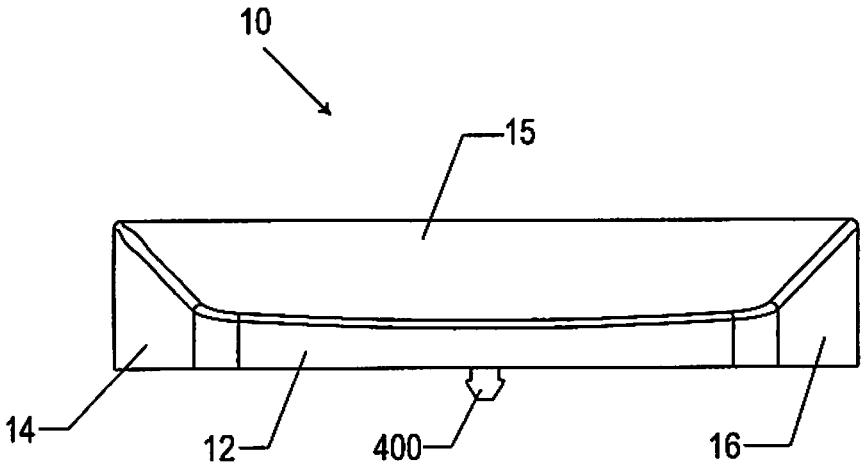
FIG. 10C is an end view of the lens cover of FIG. 10B along arrow 10C.
Figure 11C:
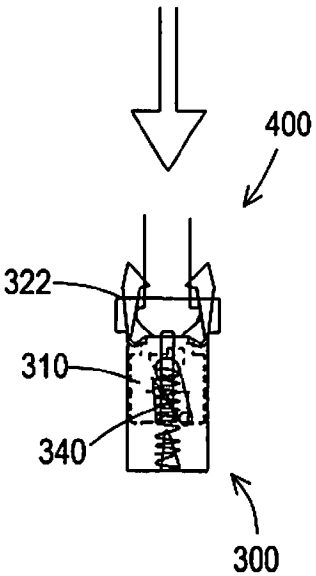
FIG. 11C shows the prong locking into the receptacle fastener of FIG. 11B.
Figure 11B:
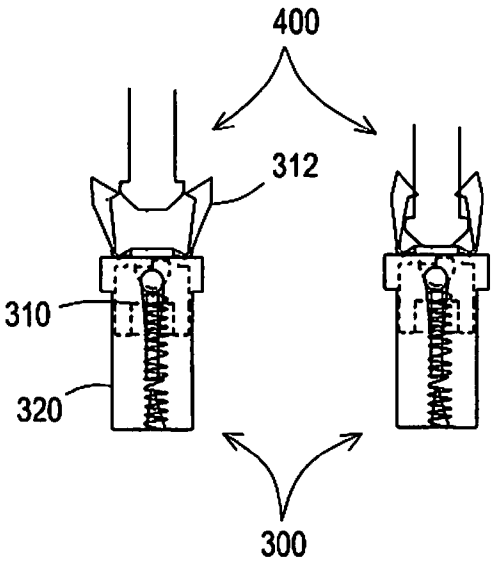
FIG. 11B shows the prong being inserted into the receptacle fastener of FIG. 11A.
Figure 11A:
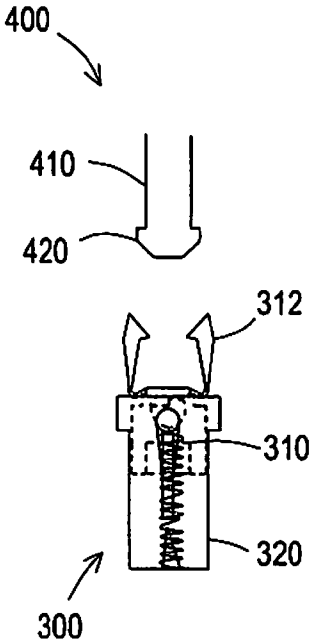
FIG. 11A shows a prong used under the lens cover about to be attached to the assembled receptacle fastener of FIG. 9.

FIG. 10 is a perspective view of the bottom of the lens cover 10 used in the bath fan 1 of FIG. 1. FIG. 11A is a side view of the lens cover 10 of FIG. 10. FIG. 11B is an end view of the lens cover 10 of FIG. 11A along arrow 11B.

Figure 11F:
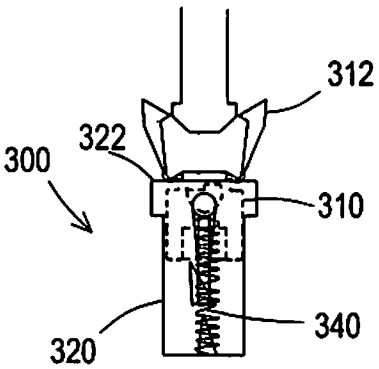
FIG. 11F shows the prong being pushed out of the receptacle of FIG. 11E.
Figure 11E:
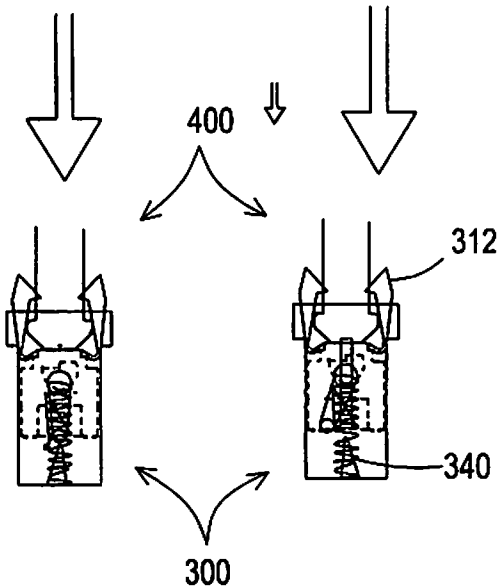
FIG. 11E shows the prong being pushed down again to start the release of the prong.
Figure 11D:
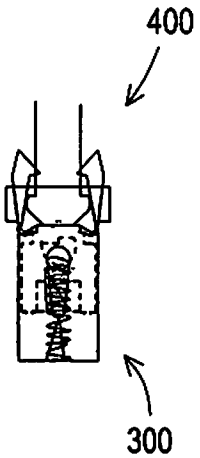
FIG. 11D shows the prong locked into the receptacle fastener of FIG. 11C.

FIG. 11A shows a prong used 400 under the lens cover 10 about to be attached to the assembled receptacle fastener 300 of FIG. 9. FIG. 11B shows the prong 400 being inserted into the receptacle fastener 300 of FIG. 11A. FIG. 11C shows the prong 400 locking into the receptacle fastener 300 of FIG. 11B. FIG. 11D shows the prong 400 locked into the receptacle fastener 300 of FIG. 11C. FIG. 11E shows the prong 400 being pushed down again to start the release of the prong 400 from the receptacle 300. FIG. 11F shows the prong 400 being pushed out of the receptacle 300 of FIG. 11E.

The lens cover 10 with prong 400 and receptical 300 can be similar to the lens cover having prong and receptical used in the assignees copending application Ser. No. 13/269,171 filed Oct. 7, 2011, by the same inventor and assignee, which is incorporated by reference. This lens cover 10 can also include depressibly releaseable fasteners that include a male prong member 400 having a shaft 410 and an enlarged head 420 that fasten into a receptical 300 as in the co-pending application.

The lens cover can include an outwardly protruding hinge end 18, and an opposite push down end 12 having the downwardly extending male prong 400 (depressible fastener). The lens cover 20 can include sidewalls 14, 16 with a top translucent surface 15 that allows light to pass therethrough. The hinge end 18 of the lens cover 10 can insert into and pivot relative to the hinge slot 26 in an end portion of the central opening 25 of the grill cover 20.

Referring to FIGS. 1-11F, to attach the light cover 10, to the grill cover 20, the unhinged end 12 of the outside of the light cover 10 is first pushed toward the grill cover 20, so that the prong 400 is first pushed (or depressed) into the bendable arms 312. This causes the bendable arms 312 to be catch the enlarged prong head 420 while the arms 312 are being pushed into the upper end 322 of the box 320 which partially compresses spring 340. Once the inner part 310 is inside the box 320, the inner part 310 is latched in place. To release the light cover 10, the opposite side of the light cover 10 is pushed toward the housing 120, this causes the inner part 310 to push down again on spring 340, which then releases the latching of the inner part 310. The expanding spring 340 causes the inner part 310 to be pushed to a raised position, with the bendable arms 312 outside the upper end 322 of the box 320, where the arms 312 expand from one another releasing the enlarged prong head(s) 420, and the light cover 10 is then free to pivot open (relative to a hinged end) 18 to allow access to change out the light sources inside of the grill cover 20.

FIGS. 11A-11D show the steps to lock the prong 400 to the receptacle fastener 300. FIG. 11A shows a prong 400 used under the lens cover 20 about to be attached to the assembled receptacle fastener 300 of FIG. 9. The prong 400 can have a shaft 410 and an enlarged head 420. The bendable arms 312 can have lower ends attached to top edges of the inner part 310 and have upper inwardly protruding hook ends FIG. 11B shows the prong 400 being inserted into the receptacle fastener 300 of FIG. 11A, where the enlarged head 420 starts to expand the upper hook ends of bendable prongs 312 until the upper hook ends hook about the enlarged head 420 of the prong 400.

FIG. 11C shows the prong 400 locking into the receptacle fastener 300 of FIG. 11B, where the hooked prong head 420 is continued to be pushed into the box 320 so that the spring 340 under the inner part 320 starts to compress inside of the box 320. FIG. 11D shows the prong 400 locked into the receptacle fastener 300 of FIG. 11C. Here, the prong arms 312 are wrapped about the head 420 so that the entire head 420 and substantially most of the arms 312 are inside the upper open end of the box 320. At this point the light cover 10 is fully attached to grill cover 20.

FIGS. 11E-11F show the steps to release a light cover 10 from the grill cover 20 FIG. 11E shows the prong 400 being pushed down again to start the release of the prong 400. By pushing down the prong 400, the inner spring 340 compresses again. FIG. 11F shows the prong 400 being pushed out of the receptacle 300 of FIG. 11E by the spring 340 pushing up against the bottom of inside part 310.

Figure 12:
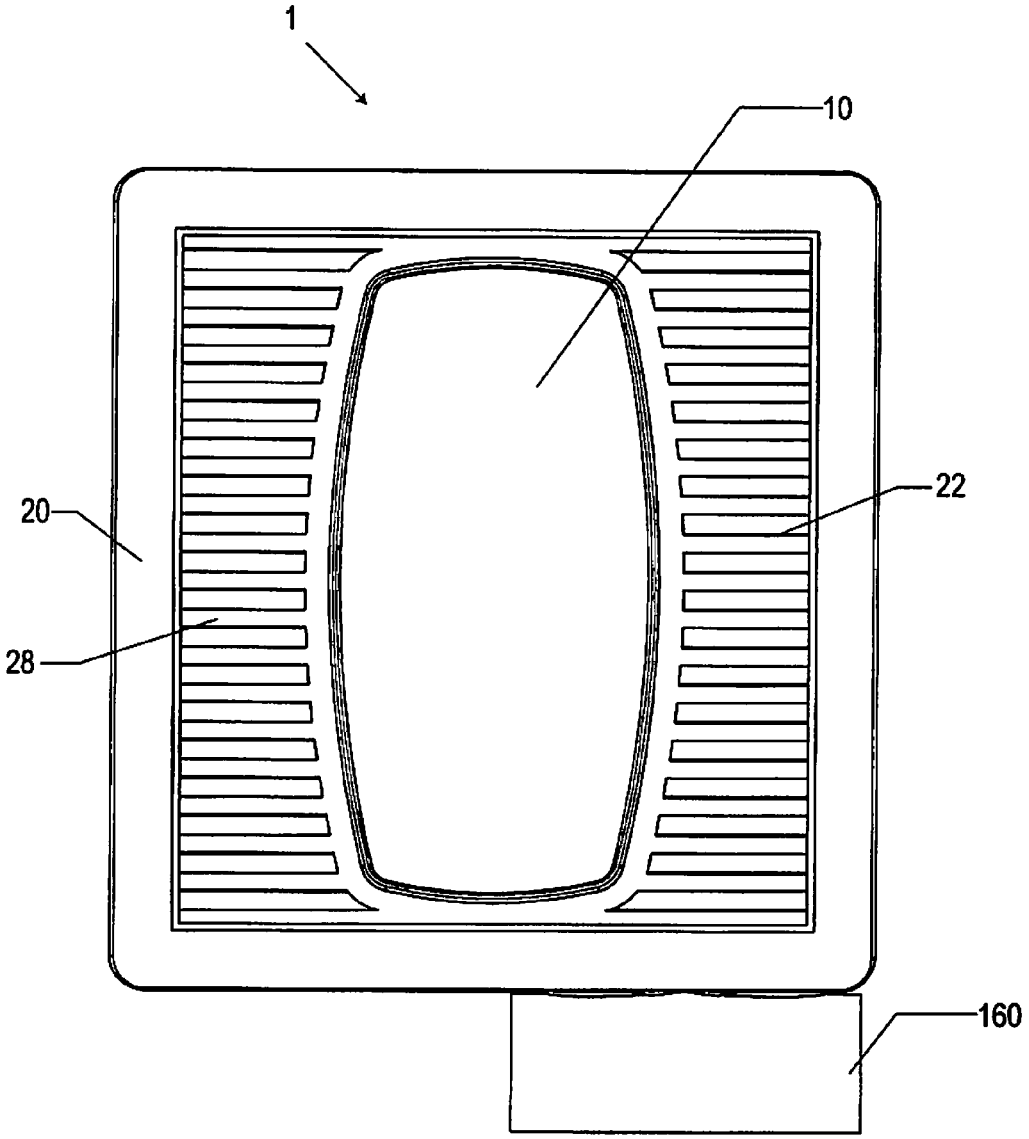
FIG. 12 is a top view of the assembled 50 CFM bath fan housing of FIG. 5 with lens cover.
Figure 13:
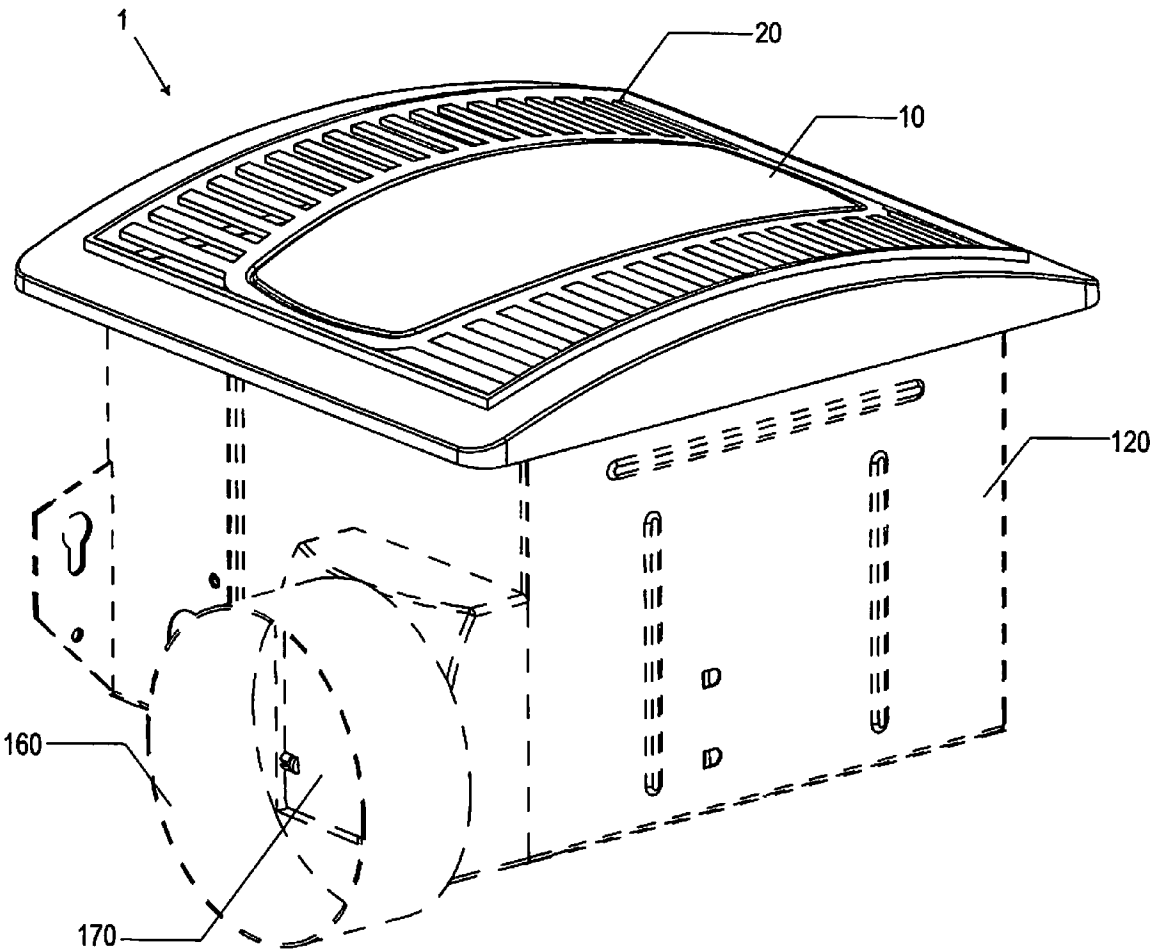
FIG. 13 is a side perspective view of the assembled 50 CFM bath fan housing of FIG. 5.
Figure 14:
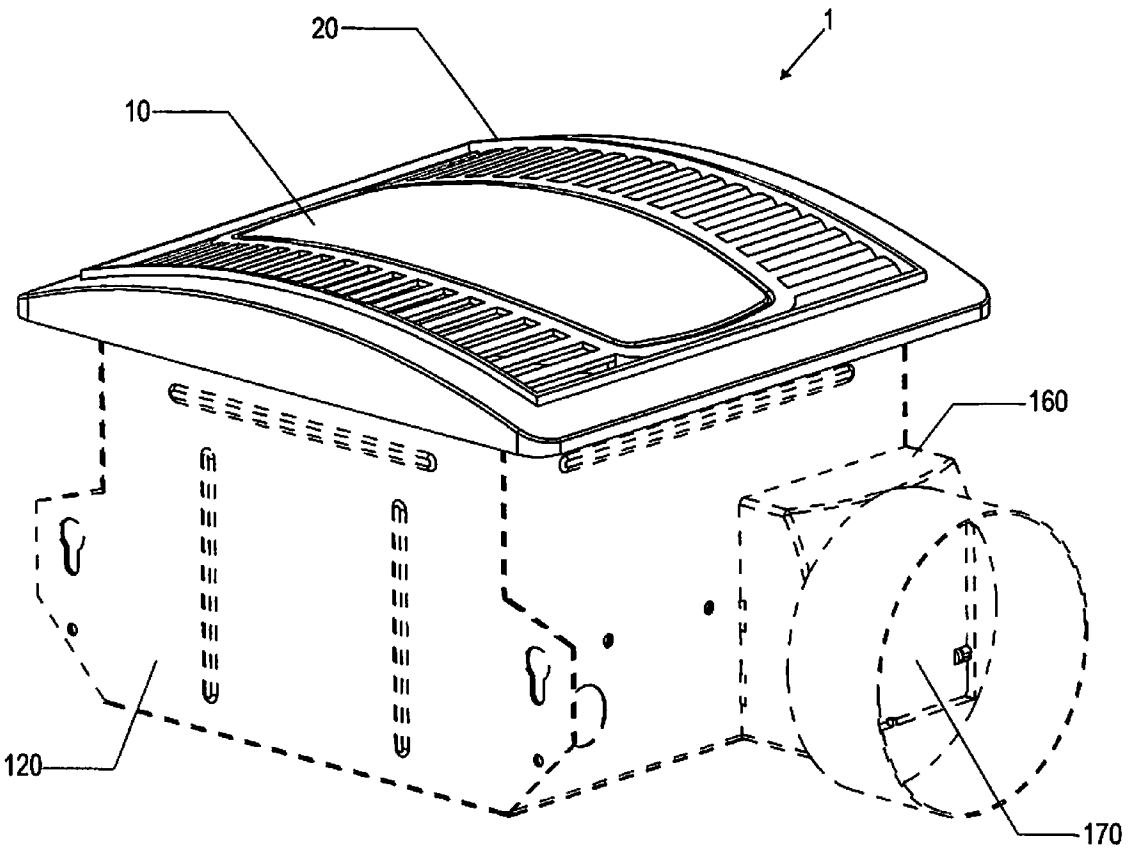
FIG. 14 is another side perspective view of the assembled bath fan housing of FIG. 5.

FIG. 12 is a top view of the assembled 50 CFM bath fan housing 1 of FIG. 5 with lens cover 10 attached to and covering the light box and light source. FIG. 13 is a side perspective view of the assembled 50 CFM bath fan housing 1 of FIG. 5. FIG. 14 is another side perspective view of the assembled bath fan housing 1 of FIG. 5.

FIG. 15 is a side view of an installed 50 CFM bath fan housing 1 with the ear flanges 122, 128 attached to joists, J, or other structural supports above a ceiling, C, by enlarged headed fasteners (not shown) be locked into the openings, such as circular openings or keyhole slots 123, 129 in the ear flanges 122, 128 on the housing 120.

Once a fastener is screwed tight the outer leg side with the ears can be flush against the joist, J and will not move. The ear flaps allow for flush mounting the bath fans 1 to the joists in less steps and using less parts than other types of mount members such as telescoping members, and the like. The flap ears can be rigid L shaped members. Alternatively, the flap ears can have a hinge between the housing mount leg, and the perpendicular extending ear leg portion, so that the flap ears are more versatile when mounting the housing inside of the ceiling.

FIG. 15 shows airflow passing into the box 120 by arrow I, and exhausting from the outlet 160 of the housing 120 by arrows O. The vents 22, 28 allow for incoming air, I, being pulled by rotating blower 100, to pass around the light box 40, so that no incoming air passes into the light box 40 to affect the light sources and electrical connections inside of the light box 40.

Although the invention uses a light cover and light, the invention can be practiced without a light cover and light.

While the preferred embodiment describes a 50 CFM fan, the invention can be practiced with a 60 CFM, 70 CFM, and 90 CFM motor and the like.

Although the preferred embodiments describe the housings to be attached directly to joists in ceilings, the invention can apply to attaching the housings to structural members in walls, and other structural members behind ceilings and/or walls.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exhaust fan, comprising:

a housing having closed side walls, a top and a bottom with an opening;

a blower inside of the housing;

a motor for running the blower;

a grill cover having vents for allowing air to be pulled into the housing by the blower wheel; and a lens cover in the grill cover for covering a light source that is mounted in a light box, wherein the motor powered blower pulls air through the vents of the grill around the light box and not into the light box, to be exhausted from the housing;

external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

2. The exhaust fan of claim 1, wherein the motor is a 50 (fifty) CFM (cubic feet per minute) generating motor.

3. The exhaust fan of claim 1, further comprising:

a removable mounting plate having the motor and the blower wheel pre-attached thereto, wherein the mounting plate with the motor and blower wheel are removable as a single piece from the inside of the housing.

4. The exhaust fan of claim 3, wherein the removable mounting plate includes:

a central opening for extending the motor down therethrough.

5. The exhaust fan of claim 1, wherein the lens cover includes:

a depressible and releaseable fastener for allowing the lens cover to be latched onto the grill cover by depressing a portion of the lens cover, and for allowing the lens cover to be removed by depressing the portion of the lens cover.

6. An exhaust fan, comprising:

a housing having closed side walls, a top and a bottom with an opening;

a blower inside of the housing;

a motor for running the blower;

a grill cover having vents for allowing air to be pulled into the housing by the blower wheel; and a lens cover in the grill cover for covering a light source that is mounted in a light box, wherein the motor powered blower pulls air through the vents of the grill around the light box and not into the light box, to be exhausted from the housing;

external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

7. An exhaust fan, comprising:

a housing having closed side walls, a top and a bottom with an opening;

a blower inside of the housing;

a motor for running the blower;

a grill cover having vents for allowing air to be pulled into the housing by the blower wheel; and a lens cover in the grill cover for covering a light source that is mounted in a light box, wherein the motor powered blower pulls air through the vents of the grill around the light box and not into the light box, to be exhausted from the housing;

a removable mounting plate having the motor and the blower wheel pre-attached thereto, wherein the mounting plate with the motor and blower wheel are removable as a single piece from the inside of the housing, the removable mounting plate includes:

a central opening for extending the motor down therethrough;

a bracket for attaching mateable electrical connectors for the light source and the motor, inside of the housing; and external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

8. An exhaust fan, comprising:

a housing having closed side walls, a top and a bottom with an opening;

a blower inside of the housing;

a motor for running the blower;

a grill cover having vents for allowing air to be pulled into the housing by the blower wheel;

a lens cover in the grill cover for covering a light source that is mounted in a light box, wherein the motor powered blower pulls air through the vents of the grill around the light box and not into the light box, to be exhausted from the housing;

a bracket inside of the housing for supporting male and female connectors for providing power to the motor and the light source; and external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

9. A ceiling mounted exhaust fan, comprising:

a housing having closed side walls, a top and bottom with an opening;

a motor attached to an impeller;

a mount plate member with an opening therethrough, the plate member having edge portions mounted inside of the housing so that the motor when mounted to the plate member allows for the motor to extend through the opening in the mount member, wherein the mount with mounted motor and attached impeller are removable as a single unit from the housing;

a bracket inside of the housing for attaching mateable electrical connectors for the motor; and external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

10. The exhaust fan of claim 9, wherein the motor is a 50 (fifty) CFM (cubic feet per minute) generating motor.

11. The exhaust fan of claim 9, further comprising:

a sealed light box in the housing;

a light source mounted in the light box; and a removable lens cover overlaying the light source.

12. A ceiling mounted exhaust fan, comprising:

a housing having closed side walls, a top and bottom with an opening;

a motor attached to an impeller;

a mount plate member with an opening therethrough, the plate member having edge portions mounted inside of the housing so that the motor when mounted to the plate member allows for the motor to extend through the opening in the mount member, wherein the mount with mounted motor and attached impeller are removable as a single unit from the housing;

a sealed light box in the housing;

a light source mounted in the light box; and a removable lens cover overlaying the light source; and a bracket inside of the housing for supporting male and female connectors for providing power to the motor and the light source; and external flaps adaptable for mounting the housing to structural supports within a ceiling, wherein the flaps each include a single base plate having a generally uniform thickness with a flat front face and a flat rear face, the flat rear face fastened to an exterior of the housing, and a single swinging flat flap plate with a flat front face and a flat rear face, the single swinging flat flap plate having two substantially parallel sides, one of said two substantially parallel sides having a longer length than two non-parallel sides, said one of the two substantially parallel sides attached by a hinge to one side of the single base plate, the single swinging flat flap plate having both a fastening opening and a keyhole slot for mounting the housing to a joist, wherein the single swinging flat flap plate is bendable from a coplanar position with the single base plate to pivot about the hinge past a 90 degree angle relative to the single base plate.

* * * * *